United States Patent [19]

Knauer et al.

[11] Patent Number: 4,911,420

[45] Date of Patent: Mar. 27, 1990

[54] ARRANGEMENT FOR TRANSPORTING A RECORD CHART BUNDLE

[75] Inventors: Norbert Knauer, Trossingen; Norbert Helmschrott, Villingen-Schwenningen, both of Fed. Rep. of Germany

[73] Assignee: Mannesmann Kienzle GmbH, Villingen-Schwenningen, Fed. Rep. of Germany

[21] Appl. No.: 316,869

[22] Filed: Feb. 28, 1989

[30] Foreign Application Priority Data

Mar. 5, 1988 [DE] Fed. Rep. of Germany ..... 3807286

[51] Int. Cl.[4] ..... B65H 3/04

[52] U.S. Cl. ..... 271/34; 271/157; 346/137

[58] Field of Search ..... 271/34, 157; 346/137

[56] References Cited

U.S. PATENT DOCUMENTS 2,703,745 3/1955 Smith ..... 346/137 X 3,064,261 11/1962 Maeder ..... 346/137

3,109,694 11/1963 Mullins ..... 346/137

*Primary Examiner*—Richard A. Schacher

*Attorney, Agent, or Firm*—Toren, McGeady & Associates

[57] ABSTRACT

An arrangement is presented which permits a record chart bundle to be deflected into a recording position at a relatively short distance from an input slot of a respective recording device at an angle of approximately 90°. For this purpose, a resilient, continuous transporting belt or a transporting belt pair driven by a motor is provided, deflecting rollers being assigned on the one hand and contact pressure rollers which are supported in a springing manner and engage in a working connection with a belt roller being assigned on the other hand to the transporting belt or transporting belt pair in such a way that a transfer gap between the belt rollers or between the transporting belts engaging around the belt rollers respectively, and the contact pressure rollers is located in the recording plane.

6 Claims, 5 Drawing Sheets

64
59
63
60
L1
22
27
58
61
62
57
30
54
53
52
68
71
66
72
67
55
69
56
73
51
L2
25
43
75
70
47
46
45
40
31
35
48
39
50
38
49
37
33
44
74
23
A
26
32
28
29
34
36
41
42

ARRANGEMENT FOR TRANSPORTING A RECORD CHART BUNDLE

BACKGROUND OF THE INVENTION

The invention is directed to an arrangement for transporting a record chart bundle to and from its recording position in a recording device in which the record chart bundle, whose individual record charts are gradually separable from the bundle connection in the course of recording, can be fed in through a slot, and in which the insertion plane, which is determined by the position of the slot, and the recording plane, in which the record chart bundle is located during the recording, intersect.

In contrast to individual record charts, record chart bundles have the advantage of providing continuous recording over a longer time period. In tachographs, for example, it is conventional to employ record chart bundles with seven record charts and to ensure a weekly recording. Accordingly, i.e. the recording carriers need only be changed weekly, which considerably facilitates the use of the tachograph which, as is known, requires a plurality of work steps and, depending on the work conditions prevailing in the driver's cab before the beginning of a trip, is often a troublesome duty.

The handling during exchanging of record charts can be further simplified and the acceptability of record chart recording devices and of the data carriers in the form of the record chart, respectively, can accordingly be improved in that record chart bundles are also fed into a shaft in the same manner as already known with individual record charts, and the rest of the functions are effected automatically.

Assuming that the problem of automatic correct positioning of record chart bundles with respect to time is solved in the respective recording device, which is inaccessible from the outside, the transporting of a record chart bundle from an insertion position, determined by the position of the input slot, into a recording position, determined by the position of the centering and driving means, does not pose any special technical difficulties when the two positions are found in substantially one and the same plane. In the case of a tachograph, the insertion of a recording carrier at the front side of the dashboard in which the respective tachograph is installed, is expected, by modern design trends in particular. As a result, there is relatively little installation space available behind the front face of the dashboard, thus necessitating a deflection of the fed-in recording carrier from an insertion plane, which intersects the front face of the dashboard, into a centering and recording plane located substantially parallel to the front face of the dashboard.

In contrast to individual record charts, whose automatic transport also does not bring about any unsurmountable difficulties in the described installation situation, there were previously considerable prejudices with regard to the drawing in and deflection of record chart bundles as a result of the thickness of such record chart bundles, which is approximately 1 mm and, accordingly, the relatively considerable stiffness as well as the central reinforcement by means of a bush which is secured to a base plate of the record chart bundle in a known manner and causes an additional impediment to transport in that it projects over the record chart bundle. An additional difficulty is that the radius of curvature of a guide shaft connecting the insertion plane and the recording plane is relatively small, since the respective tachograph is to be constructed so as to be relatively flat, and that the preferred deflection angle is in the order of magnitude of 90°—also because of the generally inclined installation position of the dashboard—so that considerable bending forces and friction moments are to be expected during transport of a record chart bundle. It is self-evident that pressure marks and stress marks on the recording surface of conventional record charts, which are sensitive to scratches and pressure, must be avoided during the transporting of the record chart bundle.

SUMMARY OF THE INVENTION

Accordingly, it is an object of the present invention to provide a transporting arrangement which permits damage-free transport of record chart bundles in a recording device in which the utilized recording carriers are fed into the recording device through a slot and automatically deflected into the recording position at a cost suitable for devices produced in series.

This object is met in that at least one continuous elastic transporting belt, which is in gear connection with a motor, is provided for driving the record chart bundle between the input slot and the recording plane. At least one stationary deflecting roller is assigned to the transporting belt in such a way that the smallest distance between one portion of the transporting belt located between the rollers and the other portion of the transporting belt located between the rollers is less than the diameter of the belt rollers guiding the transporting belt.

In a preferred embodiment of the invention the transporting belt cooperates with a stationary deflecting roller in the area of the input slot and a contact pressure roller is provided which is supported in a springing or resilient manner with the intermediary of the transporting belt on a belt roller guiding the transporting belt, wherein the line of contact between the contact pressure roller and the transporting belt lies in the recording plane.

The main advantage offered by the invention is that the one-piece or multiple-piece transporting belt, which is preferably produced from silicon rubber and is highly-elastic and adaptable in every case, first gives way or deflects at the commencement of the transport of a record chart bundle which is fed into the tachograph and only bends the record chart bundle as the depth to which it is drawn in increases, i.e. as the lever arm becomes increasingly active, and accordingly deflects it and simultaneously carries it in the drawing in direction. In other words, the transporting belt adapts to the bending behavior of the record chart bundle and the transporting belt or belts form a springing or elastic wall of the guide shaft between the input slot and the recording position which permits the stiff record chart bundle to be deflected at a right angle along a relatively short distance of approximately 40 mm.

The solution which has been found prevents torsion peaks, i.e. the torsion requirement is relatively uniform and the expenditure on drive means can be kept low. This purpose is also served by the fact that the transporting belt offers the record chart bundle a support of relatively large surface area, the contact pressure roller can accordingly act with relatively little contact pressure force and the careful transport which is aimed at is accordingly ensured with respect to the recording surface. It is noted, in addition, that the transporting belt, particularly in the preferred embodiment form, can adapt to the contour of an inserted record chart bundle on the one hand and, on the other hand, is not pulled off of the belt rollers guiding it because of shearing forces caused by record chart bundles which are not fed in so as to be exactly centered. This danger is minimized to a great extent particularly in the preferred embodiment example in which two transporting belts are used which are arranged adjacent to one another so as to be parallel.

Aside from the aforementioned advantages of the present invention, with respect to operation, constructional costs and space requirements are also low in comparison with a conceivable guide path formed by means of rollers or needles.

The invention is explained in more detail below with reference to the accompanying drawings.

DETAILED DESCRIPTION OF THE PREFERRED EMBODIMENTS

Figure 1:
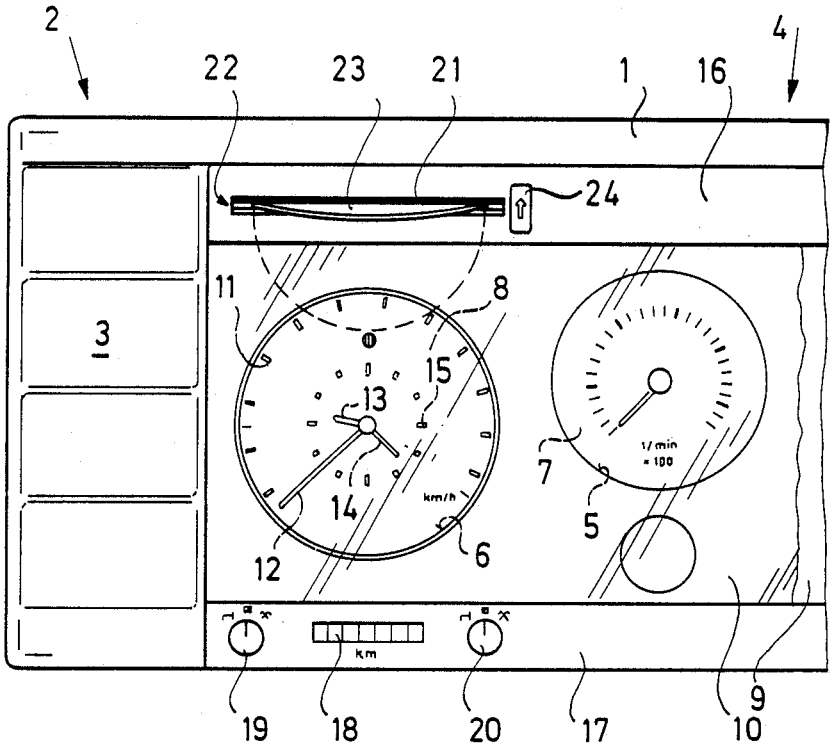
FIG. 1 is a partial view of a dashboard in which a tachograph is integrated which is equipped for automatic drawing in of record chart bundles.

The part of a dashboard or instrument console 1 shown in FIG. 1 comprises a first portion 2, in which various controls 3 are arranged, and a second portion 4 in which display instruments are arranged. A cover plate 9 assigned to the display instruments with cut-out portions for circular windows 5 and 6 for the display means of a revolution counter 7 and the display means of a tachograph 8 is covered by a glass plate 10 assigned jointly to the display instruments. The speed display means of the tachograph 8 are designated by 11 and 12, the time display means are designated by 13, 14 and 15. Additional cover plates 16 and 17, whose front surfaces lie substantially in the plane of the glass plate 10, cover the gaps at the joints between the display instruments and blank out—which is not shown—various operation monitoring display means arranged in lines and the distance counter 18 of the tachograph 8. In addition, adjusting shafts assigned to working time adjusting buttons 19 and 20 are guided through the one cover plate 17, while a cut-out portion 21 is provided in the other cover plate 16 through which an input slot 22 for record chart bundles serving as recording carriers in the tachograph 8 can be accessed, one of which record chart bundles 23 is shown in part. An internally located lock of the input slot 22, for example, or a flap which opens outward, can be actuated by means of a button 24 which engages through the cover plate 16 and is advisably lockable. Of course, the cut-out portion 21 and the working time adjusting buttons 19 and 20, as well as the kilometer counter whose display means could also be assigned to the dial face of the tachograph 8, can be changed around so that the record chart bundle 23 would have to be inserted from the bottom, so to speak. Also, an insertion from the side in FIG. 1, preferably from the left side, is conceivable.

Figure 2:
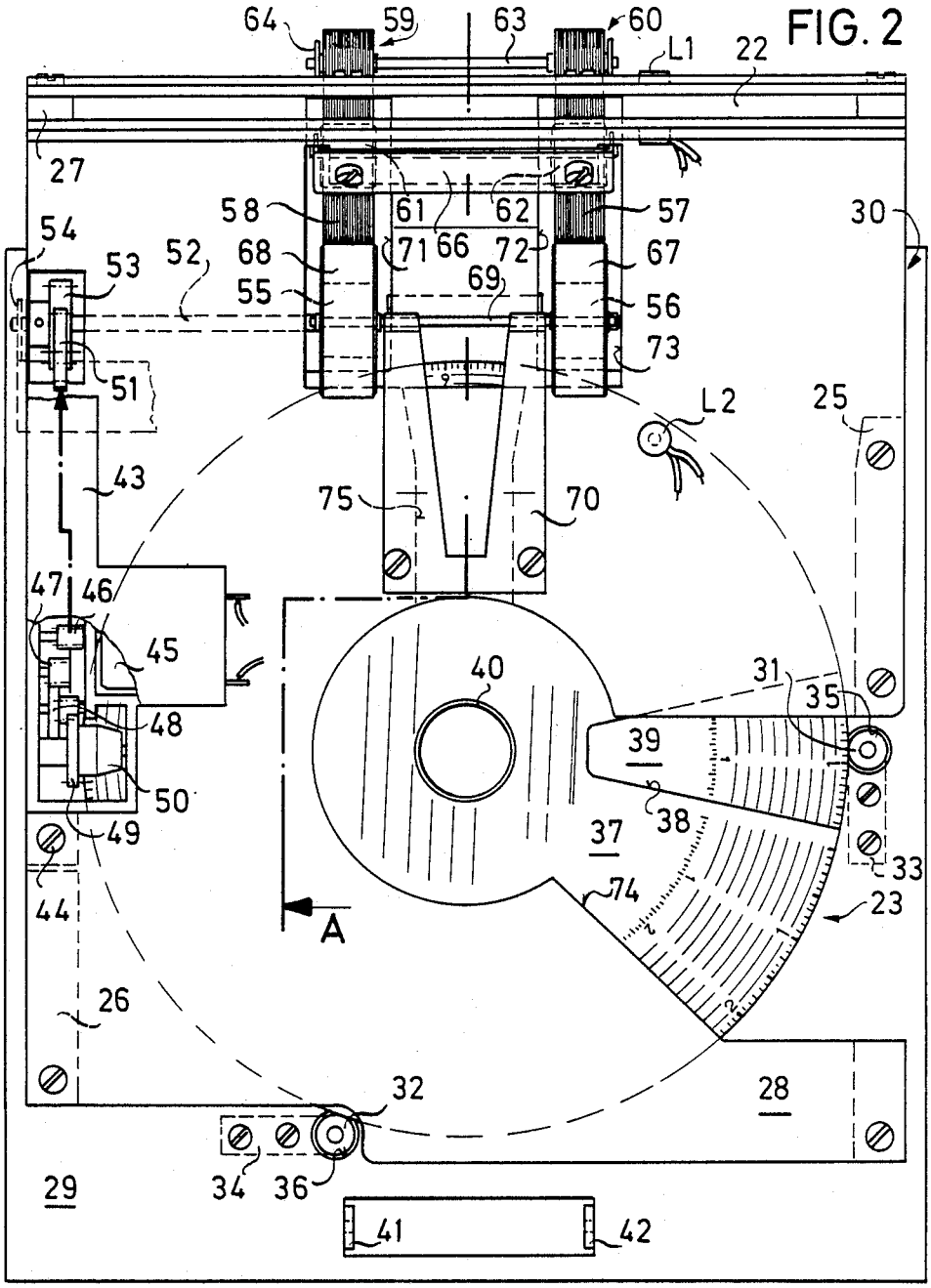
FIG. 2 is a top view of the transporting arrangement, according to the present invention.

The top view of FIG. 2 shows the recording structural components of the tachograph 8, so to speak, consisting of two angled plates 28 and 29 which are screwed together with intermediary of brackets, e.g. 25 or 26, and spacer bushes, one of which is designated by 27. The plates 28 and 29 form a guide shaft 30 between them which is substantially defined in the front by means of the brackets and spacer bushes and by means of guide rollers 31 and 32. The guide rollers 31 and 32 are rotatably supported on suitable carriers 33 and 34 connected with the plate 29 and engage through openings 35 and 36 in the plate 29 between the two plates 28 and 29. One guide roller 32 defines the guide shaft 30 in the transporting direction and accordingly determines the centering position of the inserted record chart bundle 23, the upper record chart being designated by 37 and the next record chart, which is visible through a sector-shaped cut-out portion 38 of the record chart 37, being designated by 39 in FIG. 2. The bush of the record chart bundle 23, by means of which the record chart bundle 23 is received on a centering spindle, not shown, arranged in such a way that it can be raised and lowered vertically with respect to the recording plane, is designated by 40.

For the sake of completeness, it is noted that the centering spindle, the driving means and various wheels of the recording gear mechanism are supported on an arm which is supported in turn on an axle so as to be swivelable. Tabs 41 and 42, which are formed on at the plate 29, serve as a support for this axle.

A gear unit housing 43 is likewise assigned to the plates 28 and 29 and connected with the latter (screw 44) in such a way that a portion of the toothed wheels of the gear unit and specially constructed fingers engaging between the plates 28 and 29 partially form the lateral boundary of the guide shaft 30.

Figure 3:
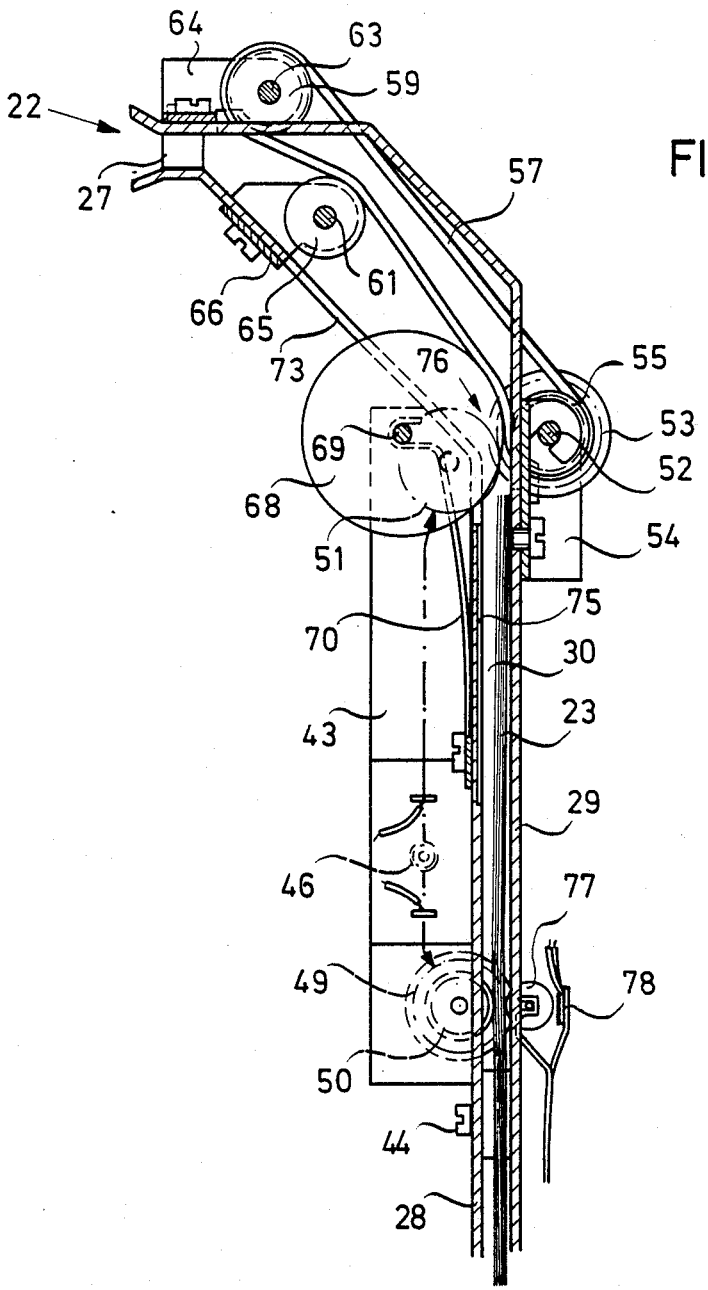
FIG. 3 is a side view of the transporting arrangement, according to the invention, along line A in FIG. 2.
Figure 4:
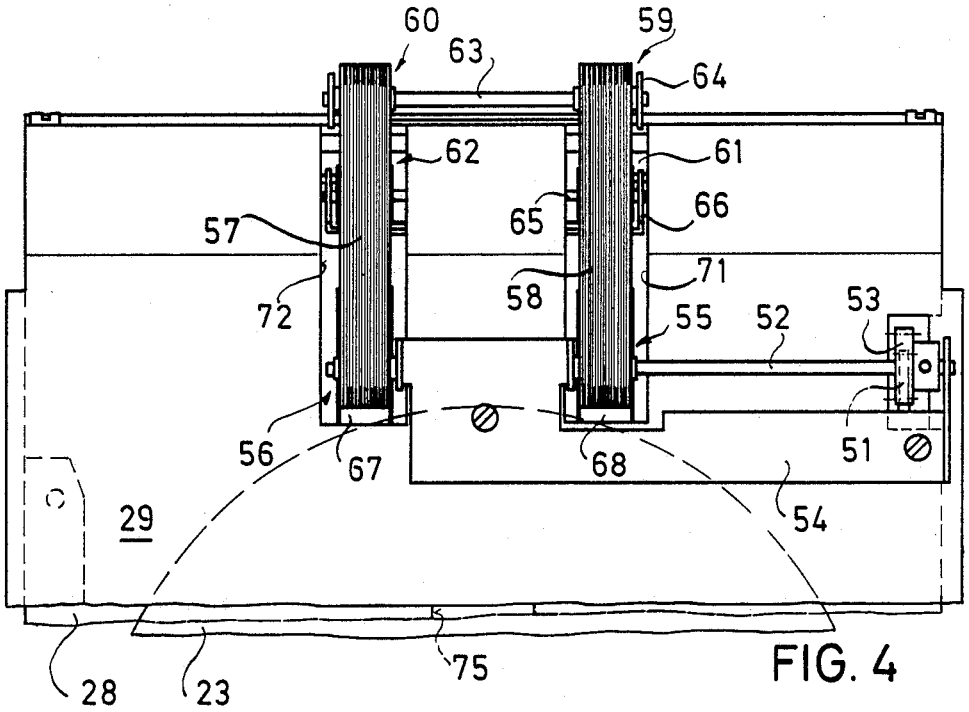
FIG. 4 is a partial rear view of the transporting arrangement according to FIG. 2.
Figure 5:
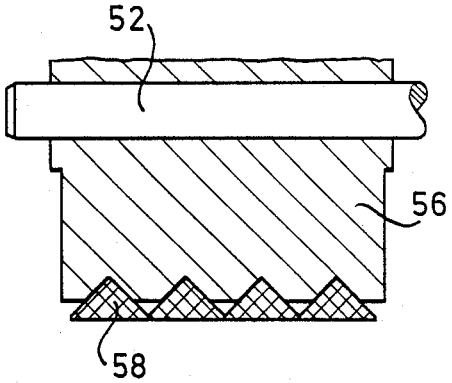
FIG. 5 is a cross section of the transporting belt.

FIGS. 2, 3 and 4 are considered alternately in the following for better comprehension. A first gear unit branch of the gearing mechanism supported in the gear unit housing 43 drives a transporting roller 50 proceeding from a pinion 46 fastened on the shaft, not designated by a reference number, of a motor 45, via the toothed wheel pairs 47 and 48 and the toothed wheel 49. Another gear unit branch, of which only the intermediate wheel 51 is shown, connects the pinion 46 with a toothed wheel 53 fastened on a shaft 52 in a gear connection. The shaft 52 is supported in a bearing bridge 54 assigned to the plate 29 and, according to the shown preferred embodiment carries a first and a second belt roller 55 and 56, respectively. Two additional belt rollers 59 and 60, as well as a deflecting roller 61 and 62, in each instance, are assigned to the two transporting belts 57 and 58. The belt rollers 59 and 60 are fastened on a shaft 63 which is supported in a bearing bridge 64 assigned to the plate 29, while the deflecting roller pair 61, 62 is arranged on a shaft 65, to which is assigned a bearing bridge 66 fastened at the plate 28. In addition, a contact pressure roller 67 and 68 is assigned to each transporting belt 57, 58, specifically in such a way that the direction of action of the force of a leaf spring 70 acting at a shaft 69 assigned to the contact pressure rollers is directed substantially radially with respect to the driving belt rollers 55 and 56. The transporting belts 57 and 58 engage through suitable cut-out portions 71 and 72 in the plate 29 and the contact pressure rollers 67 and 68 engage into the guide shaft 30 through an opening 73 in the plate 28. The leaf spring 70, which is fastened on the plate 28, is preferably constructed so as to have two arms, and a bearing shell assigned to the shaft 69 is formed on at the end of each arm as shown in FIG. 3.

It is noted in addition that it is not only the centering and driving means which engage into the guide shaft 30 through a cut-out portion 74 in the plate 28 and enter into a working connection with the record chart bundle 23, but also the recording members and a severing device, which are not shown because they are not substantial to the invention. The severing device severs the respective inscribed record chart from the record chart bundle 23 and holds it at a stop. The severing device and the recording members are also arranged so as to be swivelable vertically with respect to the recording plane in order to free the guide shaft 30 for the input and output of a record chart bundle. A groove 75 which is provided in the plate 28 constitutes a cut-out portion and a certain guidance for the bush 40 projecting over the record chart bundle 23.

Figure 6A:
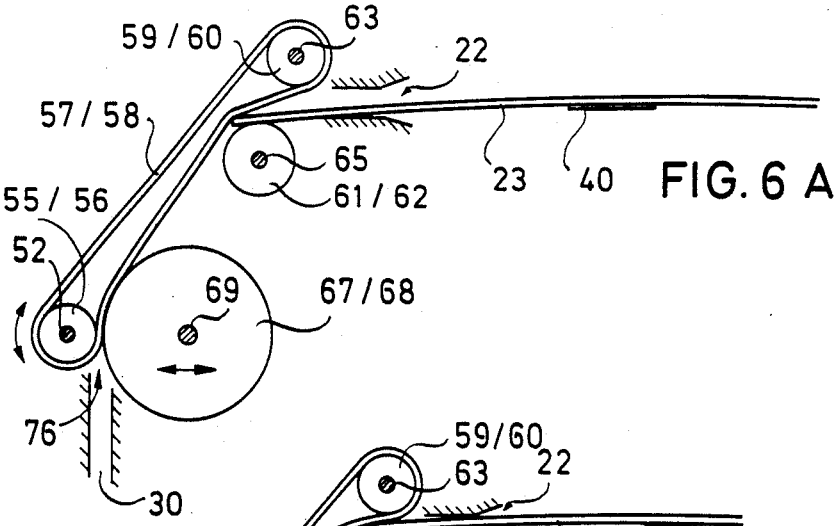
FIGS. 6A, B and C show operating positions of the transporting arrangement during drawing in of a record chart bundle.
Figure 6B:
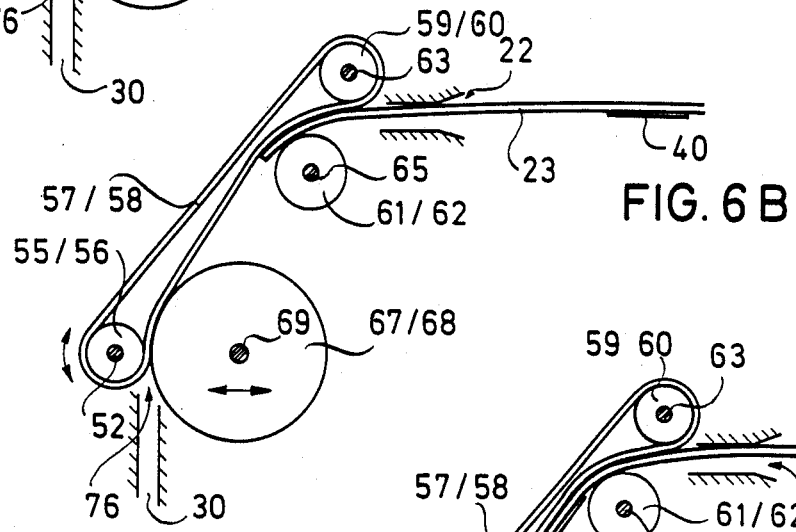
Figure 6C:
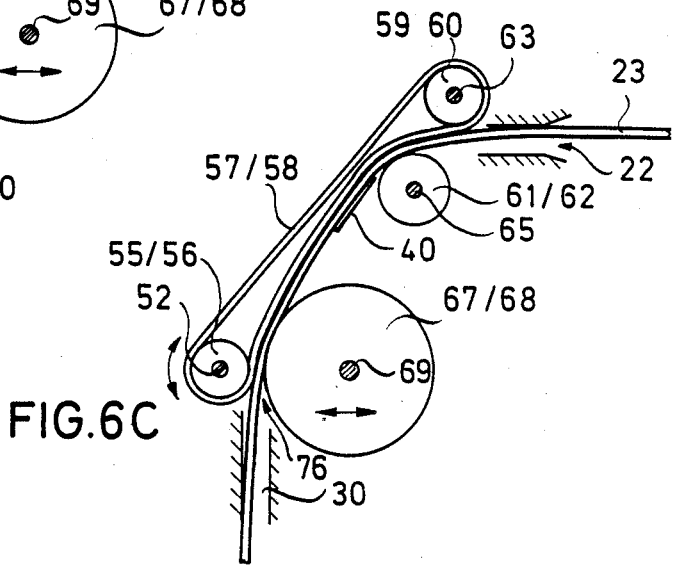

The functioning of the transporting arrangement, according to the invention, is explained in more detail in the following. When a record chart bundle 23 is inserted into the tachograph 8, the locking mechanism of the slot 22 is first disengaged by means of actuating the button 24. If a record chart bundle is located in the tachograph 8, the lifting of the recording members, centering pin, driving means and severing device engaging between the record chart bundle is triggered by means of actuating the button and a switching to the feed-out of the record chart bundle is effected with a suitable time gap of the motor 45 of the transporting belt. The motor 45 of the transporting belt is switched off when one of the two light barriers L1, L2, that is, L1, is no longer interrupted, i.e. when the record chart bundle projecting out of the slot 22 is removed or, in case it has not been removed, when a certain period of time has expired. If the guide shaft is free, a new record chart bundle 23, i.e. one that has not been printed on, or also the one that has just been removed for checking, can be inserted and advanced up to the support line between the transporting belts 57, 58 and the deflecting rollers 61, 62. In so doing, the light barrier L1 is interrupted and the motor 45 of the transporting drive is controlled to draw in the record chart bundle 23. First, the transporting belts 57 and 58 give way in an elastic manner, as shown in FIG. 6A, because of the stiffness of the record chart bundle 23. It is only in the continued course of transporting the record chart bundle 23 as the belt tension increases and the lever arm increases, i.e. as the depth to which it is drawn in increases, that the record chart bundle 23 is bent at the deflecting rollers 61, 62, according to FIG. 6B, and guided against the transfer gap 76 between the transporting belts 57 and 58 and the springing contact pressure rollers 67 and 68, the transfer gap 76 being assigned in a fixed manner to the recording plane. While the record chart bundle 23 is still located in the transfer gap 76 (FIG. 6C), it is taken over by the transporting roller 50, guided into the centering position and driven in the circumferential direction, that is, until the record chart bundle 23 is positioned correctly with respect to time. In this case, the record chart bundle stands still and a pulse generator, which is assigned to the transporting roller 50 and consists of a radially magnetized counter-pressure roller 77 and a Hall sensor 78, then no longer supplies pulses. A switching off of the transporting drive and a coupling of the record chart bundle 23 with the recording drive is controllable with this signal state.

The removal of the record chart bundle from the transfer gap 76 need not necessarily be effected by means of the transporting roller 50. It can also be effected by means of the centering spindle which is conically constructed in a suitable manner, wherein it is sufficient that contact with the transporting belts and the contact pressure rollers, respectively, be avoided during the recording movement of the record chart bundle.

In contrast to the above-described embodiment, the invention can also be realized in the simplest case in that a stationary deflecting roller having a greatest possible diameter is assigned to a single relatively wide transporting belt.

Figure 7:
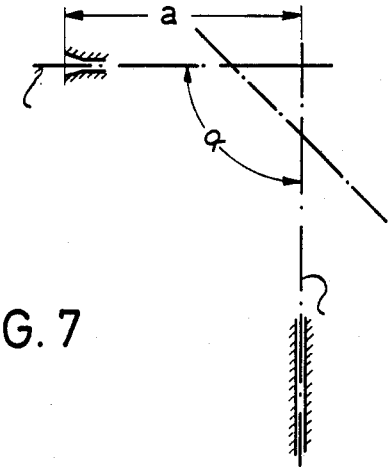
FIG. 7 is a location plan.

The location plan in FIG. 7 shows in a simplified and accordingly striking manner the problem upon which the invention is based, namely the need to deflect a relatively rigid recording carrier (record chart bundle) from an insertion plane into a recording plane after a very short distance a at a relatively acute angle $\alpha$. While the invention has been illustrated and described as embodied in an arrangement for transporting a record chart bundle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for transporting a record chart bundle to and from a recording position in a recording device in which the record chart bundle, whose individual record charts are gradually separable from the bundle connection in the course of recording, can be fed in through an input slot, and in which an insertion plane, which is determined by the position of the slot, and a recording plane, in which the record chart bundle is located during the recording, intersect, comprising: a motor; at least one continuous elastic transporting belt in a gear connection with said motor provided so as to drive the record chart bundle between the input slot and the recording plane; belt rollers provided so as to guide the belt; and at least one stationary deflecting roller assigned to the transporting belt so that a smallest distance between one portion of the transporting belt located between the rollers and another portion of the transporting belt located between the rollers is smaller than the diameter of the belt rollers guiding the transporting belt.

2. An arrangement according to claim 1, wherein the transporting belt has a tooth profile transverse to the transporting direction.

3. An arrangement according to claim 1, wherein the transporting belt is formed from a plurality of round cords.

4. An arrangement according to claim 1, wherein the transporting belt cooperates with a stationary deflecting roller in the area of the input slot, and further comprising a contact pressure roller supported, with the intermediary of the transporting belt, in a springing manner on one of the belt rollers guiding the transporting belt, a line of contact between the contact pressure roller and the transporting belt lying in the recording plane.

5. An arrangement according to claim 4, and further comprising at least one transporting roller assigned to the transporting belt so as to effect a conveying of an inserted record chart bundle in the recording plane.

6. An arrangement according to claim 1, and further comprising a second transporting belt and a drive jointly assigned to both belts, the belts being arranged adjacent to one another so as to be parallel at a distance which is greater than the diameter of a bush of a record chart bundle.

* * * * *